US008496111B2

(12) United States Patent
Hansen et al.

(10) Patent No.: US 8,496,111 B2
(45) **Date of Patent: *Jul. 30, 2013**

(54) DOUBLE HINGE DISPLAY PACKAGE AND METHOD OF USE

(75) Inventors: Victor D. Hansen, Rockford, MI (US); George E. Raimer, Saranac, MI (US); Kristie L. Vos, Marne, MI (US); Brian J. Pankratz, Rockford, MI (US); Michael J. Cramblet, Muskegon, MI (US); Elliott R. Eckert, East Grand Rapids, MI (US)

(73) Assignee: Display Pack, Inc., Grands Rapids, MI (US)

( * ) Notice: Subject to any disclaimer, the term of this patent is extended or adjusted under 35 U.S.C. 154(b) by 268 days.

This patent is subject to a terminal disclaimer.

(21) Appl. No.: 13/053,514

(22) Filed: Mar. 22, 2011

(65) Prior Publication Data

US 2011/0168731 A1 Jul. 14, 2011

Related U.S. Application Data

(63) Continuation of application No. 12/640,053, filed on Dec. 17, 2009, now Pat. No. 7,931,148, which is a continuation-in-part of application No. 29/338,389, filed on Jun. 10, 2009, now Pat. No. Des. 624,402.

(51) Int. Cl.
*B65D 73/00* (2006.01)

(52) U.S. Cl.
USPC ..... 206/470; 206/461; 206/463; 220/4.23; 220/254.1; 220/254.3

(58) Field of Classification Search
USPC ..... 206/349, 470, 471, 365, 467, 461, 206/463; 220/824, 4.22, 4.23, 254.1, 254.3
See application file for complete search history.

(56) References Cited

U.S. PATENT DOCUMENTS

| | | | | |
|---|---|---|---|---|
| 3,111,220 | A | 11/1963 | Donald | |
| 4,083,451 | A * | 4/1978 | Hair | 206/461 |
| 4,266,666 | A | 5/1981 | Kuchenbecker | |
| 4,319,684 | A * | 3/1982 | Backman et al. | 206/464 |
| D263,684 | S | 4/1982 | Davis | |
| 4,456,124 | A * | 6/1984 | Kay et al. | 206/463 |
| 4,666,037 | A | 5/1987 | Weissman | |
| 4,739,883 | A * | 4/1988 | Mohs et al. | 206/470 |
| D376,314 | S | 12/1996 | Krupa | |
| 5,775,516 | A | 7/1998 | McCumber et al. | |
| D407,015 | S | 3/1999 | Jones | |
| D411,448 | S | 6/1999 | Baker | |
| D420,905 | S | 2/2000 | Adkins | |

(Continued)

OTHER PUBLICATIONS

Design Drawings dated Feb. 2, 2009.

*Primary Examiner* — Andrew Perreault
(74) *Attorney, Agent, or Firm* — Warner Norcross & Judd LLP

(57) ABSTRACT

A clamshell package for supporting an article is provided including a covered manufacturing hinge adapted to divide the clamshell into first and second parts adapted to form a cavity. The first and second parts partially overlap to form a flange adjacent the manufacturing hinge. The second part includes an uncovered operating hinge, about which the second part is adapted to pivot away from the first part to an open position. The clamshell package includes a panel adapted to engage the manufacturing hinge and flange to retain the manufacturing hinge in a folded position, with the panel being spaced from the operating hinge.

24 Claims, 6 Drawing Sheets

U.S. PATENT DOCUMENTS

| | | | | |
|---|---|---|---|---|
| 6,053,321 | A | 4/2000 | Kayser | |
| 6,230,964 | B1 | 5/2001 | Saito | |
| 6,244,444 | B1 * | 6/2001 | Jacobus et al. | 206/703 |
| D448,288 | S | 9/2001 | Zettle et al. | |
| 6,308,832 | B1 * | 10/2001 | Pirro et al. | 206/469 |
| 6,364,115 | B1 | 4/2002 | Casanova et al. | |
| D479,127 | S | 9/2003 | Jowett | |
| D531,028 | S | 10/2006 | Weiss et al. | |
| D534,421 | S | 1/2007 | Tanner | |
| D553,489 | S | 10/2007 | Lambert et al. | |
| D600,113 | S | 9/2009 | Edwards et al. | |
| D601,014 | S | 9/2009 | Petitjean | |
| 2002/0195363 | A1 | 12/2002 | Tuneberg | |
| 2008/0118609 | A1 | 5/2008 | Harlfinger | |

* cited by examiner

DOUBLE HINGE DISPLAY PACKAGE AND METHOD OF USE

BACKGROUND OF THE INVENTION

The present invention relates to packaging, and more particularly to point-of-sale product packages.

A wide variety of products intended for retail sale are packaged in packaging that includes plastic components. One of the most common forms of plastic point-of-sale packages is a blister package. A typical blister package includes a shaped plastic blister that forms the main cavity of the package and a backer panel that closes the cavity. The backer panel is often sealed to the blister, for example, by adhesive to enclose the product within the cavity. The backer panel may be formed from paperboard, plastic, aluminum or other similar materials. Because of the use of a paperboard backer panel, a blister package has the potential to be a relatively low cost packaging solution. The amount of plastic used to contain the product is relatively small and the backer panel can be sized to provide ample space for printed content.

Another common form of plastic point-of-sale package is a clamshell package. A typical clamshell package includes a pair of formed plastic parts (often "halves") that are joined along a hinge. The parts can be closed about the hinge to entrap the product to be packaged. Clamshell packages vary dramatically in design and configuration. For example, some clamshell packages are sealed shut to protect the contents of the package until it is opened, while other clamshell packages are resealable. With sealed clamshell packages, it is often necessary to at least partially destroy the package to gain access to the contents. In a resealable configuration, the clamshell can be formed with contours that permit the two clamshell parts to be friction interfitted in a way that holds the parts together in a closed configuration about the packaged contents. It is not uncommon to incorporate paper or paperboard inserts into clamshell packages. For example, information and other content can be printed on an insert that is enclosed within the clamshell.

In some applications, a hybrid clamshell package is formed by securing paperboard panels or other similar materials around the peripheral edges of the clamshell. The hybrid package provides, among other things, the added advantage of additional space for additional printed content. Although it enjoys some benefits, the presence of the hinge in the clamshell presents a challenge to hybrid package construction. Conventional constructions provide two options for dealing with the hinge. In one type of construction, the hinge is trapped between the paperboard panels. This provides a strong package because the clamshell is joined to the paperboard around its entire periphery. However, because the hinge is positioned between the paperboard panels, opening and closing of the package forces the paperboard apart, which can cause the paperboard to buckle and tear near the hinge. This problem can be exacerbated with repeated opening and closing of the blister. The peeling and tearing of the paperboard can ultimately break the connection between the paperboard and the blister, which can weaken the package and impact its aesthetic appearance. The second type of hybrid construction includes paperboard panels that are shaped so that they do not entrap the hinge. This prevents the issues of buckling and tearing discussed above, but provides a somewhat weaker package because the clamshell and paperboard panels are not laminated along the hinge.

SUMMARY OF THE INVENTION

The present invention provides a hybrid package having a clamshell with a peripheral flange and at least one backer panel extending over at least a portion of the flange. The clamshell includes an operating hinge that is adjacent the flange, but spaced from the panel to enable opening and closing of the clamshell when the flange is covered by the panel. In one embodiment, the clamshell includes two hinges, including a manufacturing hinge disposed along the peripheral edge of the flange and the operating hinge disposed inwardly from the peripheral edge. In one embodiment, the manufacturing hinge permits the clamshell to pivot or fold over itself during manufacture to bring the clamshell parts into mating alignment and the operating hinge permits the clamshell to be opened and closed after the package is completed. In this embodiment, the region between the two hinges defines at least a portion of the flange such that the flange and panel may engage adjacent to the operating hinge.

According to one aspect, the package includes a first hinge to divide the clamshell into first and second parts that are shaped to cooperatively form a cavity to contain the packaged article(s) and a flange extending around at least a portion of the periphery of the clamshell. The first part may include a peripheral lip that extends entirely about the first part. The second part may include a second hinge spaced apart from the first hinge by a lip section. When the first and second parts are folded together along the first hinge, the lip section of the second part overlaps the peripheral lip of the first part, and they cooperatively define the flange. The second hinge is disposed inwardly from the peripheral edge and provides a hinge about which the second part is adapted to pivot away from the first part to an open position. The panel is joined to flange along at least a portion of the overlapped flange section, with the second hinge being free from the panel so that the second part can pivot about the second hinge without placing any stress on the panels.

In one embodiment, the package includes front and rear panels joined together to sandwich and cover the first hinge and at least a portion of the flange. The panels may optionally extend around the entire periphery of the first blister section.

In another embodiment, the second hinge may be a square hinge that reinforces the second part and allows the second part to pivot further away from the first part.

In yet another embodiment, one of the first and second parts may include a snap element that corresponds to a notch on the other of the first and second blister sections, such that the snap element may be snap-fitted into the notch to securely retain the closure over the opening. The characteristics of the snap element and/or notch, such as shape and length, may be varied to provide the stiffness desired to retain the snap element in engagement with the notch.

In another aspect of the invention, a method is provided for forming a hybrid package with a clamshell having at least two hinges, a first one of the hinges covered by a panel and the second hinge spaced from the panel. The first hinge enables the blister to pivot or fold over itself along the first hinge to close the clamshell and create a flange along at least a portion of the clamshell, and the second hinge enables the clamshell to pivot or fold at a position inward from the flange along to open the package.

In one embodiment, the method includes the steps of: (a) forming a clamshell including a first hinge dividing the clamshell into first and second parts, the second part including a second hinge; (b) folding the clamshell about the first hinge to form a cavity between the first and second parts, with the first and second parts forming an overlapped flange adjacent the first hinge; (c) attaching a panel to the first hinge and to the flange with the second hinge exposed; and (d) pivoting the second part about the second hinge to open the package.

Thus, a package is provided that has a double hinge design in which a clamshell can be formed by pivoting the package about a first hinge covered by a panel and opened by pivoting a part of the package about a second hinge that is spaced from the first hinge and not covered by the panel. The clamshell can be integrally formed and assembled, which is cost effective and makes the package relatively easy to manufacture. Because the first hinge connects the second part and the first part, the first and second parts do not need to be separately aligned when the clamshell is being formed, which simplifies the manufacturing process. Further, by having a flange extending along the first hinge and at least partially covered by a panel, the package maintains its structural integrity. Also, in those embodiments in which the panel is paperboard, the package can be configured to provide ample space for printed content while reducing the amount of plastic required to make the package. Additionally, the package can be repeatedly opened and closed without the second hinge causing damage to the panel(s).

These and other objects, advantages and features of the invention will be more readily understood and appreciated by reference to the detailed description of the invention and the drawings.

DETAILED DESCRIPTION OF THE CURRENT EMBODIMENT

Figure 1:
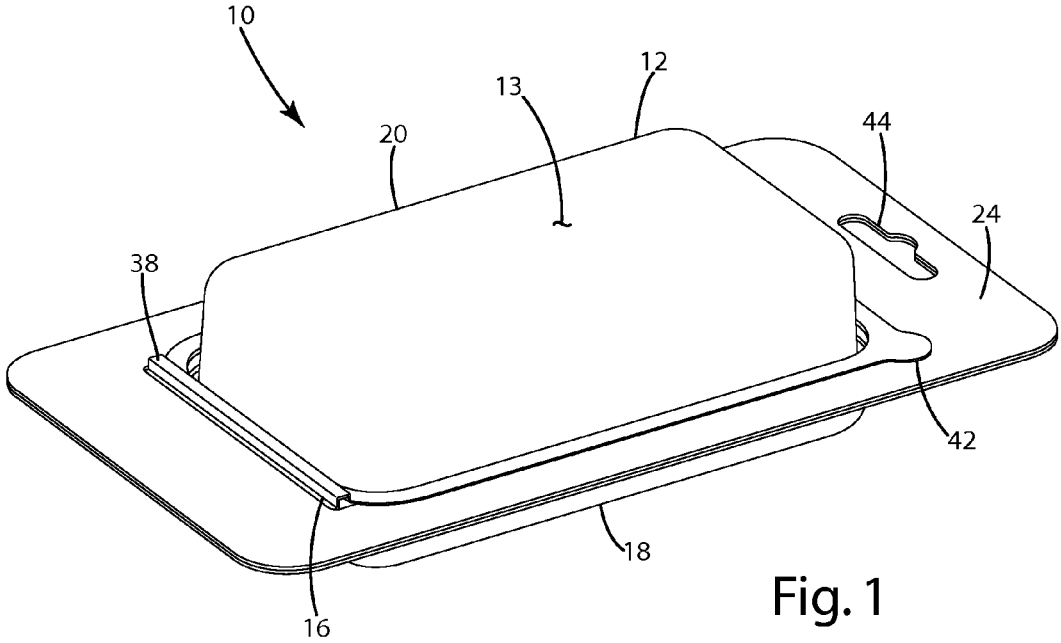
FIG. 1 is a perspective view of a clamshell package in accordance with an embodiment of the present invention.
Figure 3:
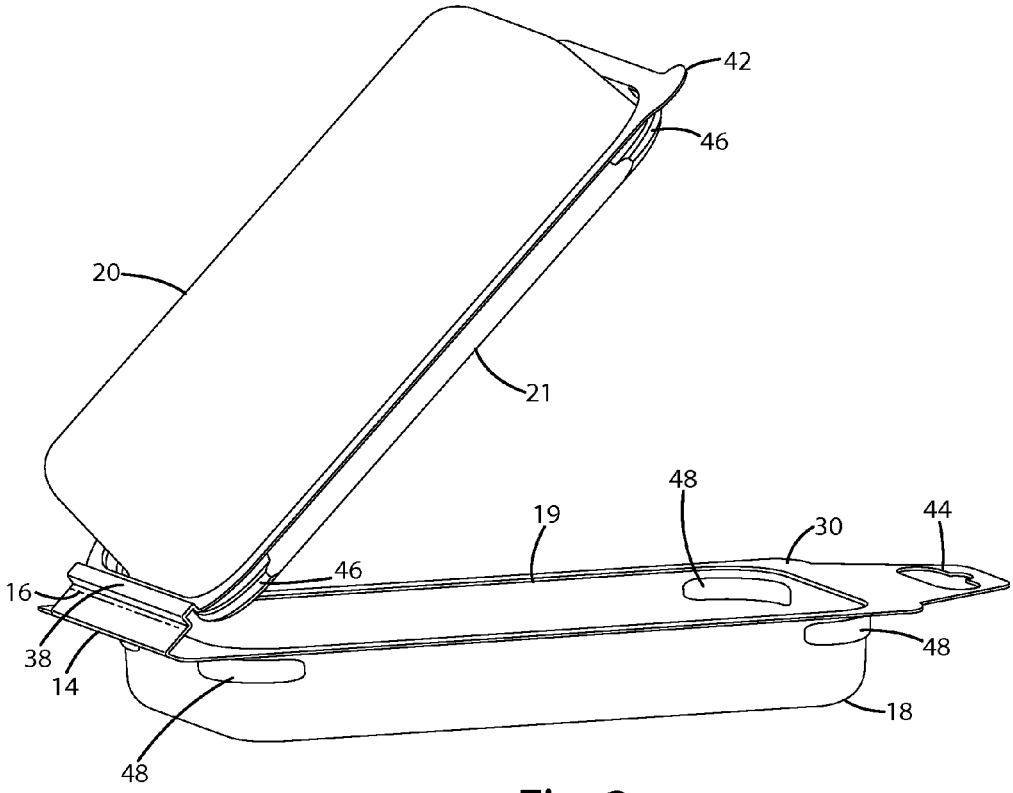
FIG. 3 is a perspective view of the clamshell in an open position.
Figure 6:
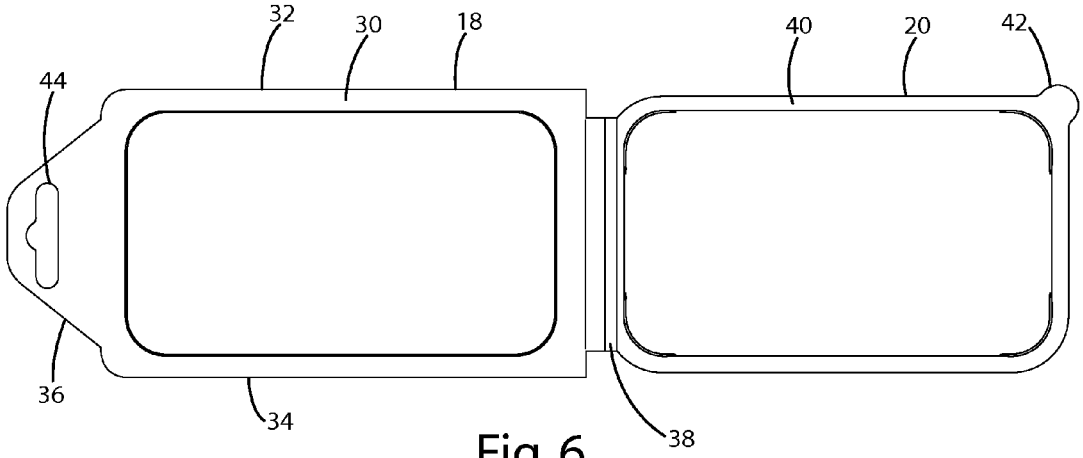
FIG. 6 is a top plan view of a clamshell in an open position.
Figure 9:
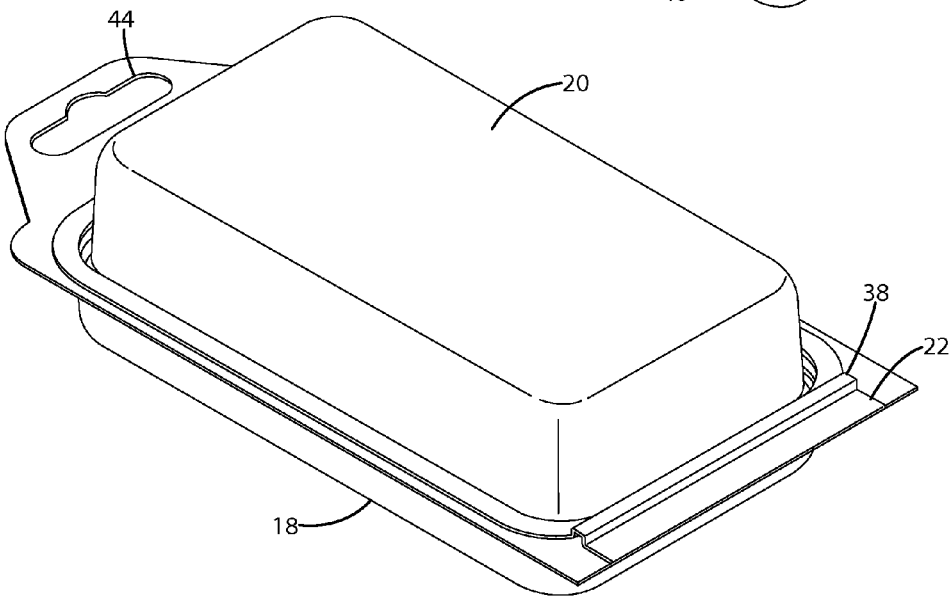
FIG. 9 is a perspective view of the clamshell in a closed position.

A clamshell package in accordance with an embodiment of the invention is shown in FIG. 1 and is generally designated 10. The clamshell package 10 is designed to hold and display articles for sale and includes a clamshell 12 and a panel 24. In the illustrated embodiment, the clamshell 12 includes a manufacturing hinge 14 adapted to divide the clamshell into first and second parts 18 and 20, which are shaped to cooperatively form a cavity 13 adapted to contain the packaged article(s) (FIGS. 1 and 3). The first and second parts 18, 20 may each include a peripheral lip 30, 40 that extends about the respective first and second parts 18, 20 (FIG. 6). When the first and second parts 18, 20 are folded together along the manufacturing hinge 14, the lip 40 overlaps the lip 30 to form a flange 22 adjacent the manufacturing hinge 14 and along a peripheral edge of the clamshell 12 (FIG. 9). The second part 20 includes a second, operating hinge 16 that is spaced from the manufacturing hinge 14 and allows the second part 20 to move with respect to the first part 18 while the flange 22 is in an overlapped position. The panel 24 engages the flange 22 to retain the flange in an overlapped position, but is spaced from the operating hinge 16 at a distance that will at least allow the second part 20 to pivot about the operating hinge 16 without placing any stress on the panel 24.

The clamshell 12 can be virtually any desired size and shape depending on the article to be packaged and on aesthetic considerations. In the illustrated embodiment, the first and second parts 18 and 20 form a respective pocket 26, 28, which, when folded in a closed position, create the cavity 13. The pockets 26, 28 are generally rectangular in shape, with rounded edges, and are configured to align when the clamshell is folded about the manufacturing hinge 14. However, the pockets can alternatively be round, oval or any other suitable shape.

The clamshell 12 may be injection molded or thermoformed, and is typically constructed from polyvinyl chloride (PVC) or polyethylene terephthalate (PET) or some other polymer. Although the clamshell stock is typically transparent, translucent or clear, the stock may also be opaque, clouded or tinted any suitable color in some applications. The clamshell 12 will vary in thickness from application to application. For standard applications, the clamshell 12 is likely to have a thickness ranging between 12 and 30 gauge (i.e., 12 to 30 thousands of an inch).

The manufacturing hinge 14 that connects the first and second parts together can be any suitable type of connection that allows the first and second parts 18, 20 to move with respect to each other. For example, the hinge 14 can be a line of weakening in the clamshell material, such that the first and second parts 14, 16 are integrally formed and fold at the line of weakening, which could include a fold line, a line of reduced thickness or a perforation. Alternatively, the hinge 14 could be a standard hinge that allows the first and second parts 18, 20 to pivot with respect to each other.

Figure 2:
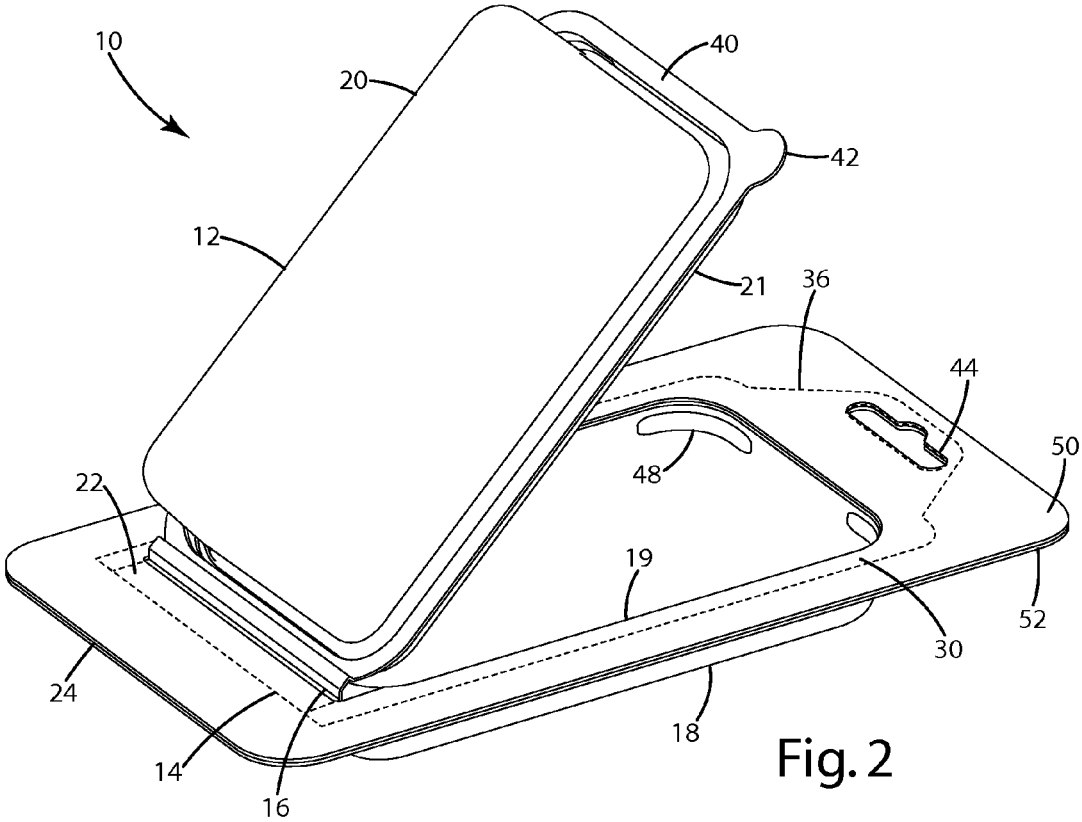
FIG. 2 is a perspective view of the clamshell package in an open position.
Figure 7:
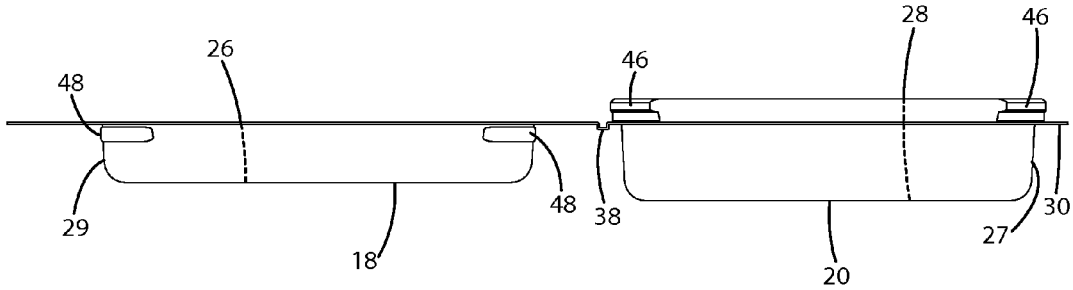
FIG. 7 is a side elevational view of the clamshell in an open position.
Figure 8:
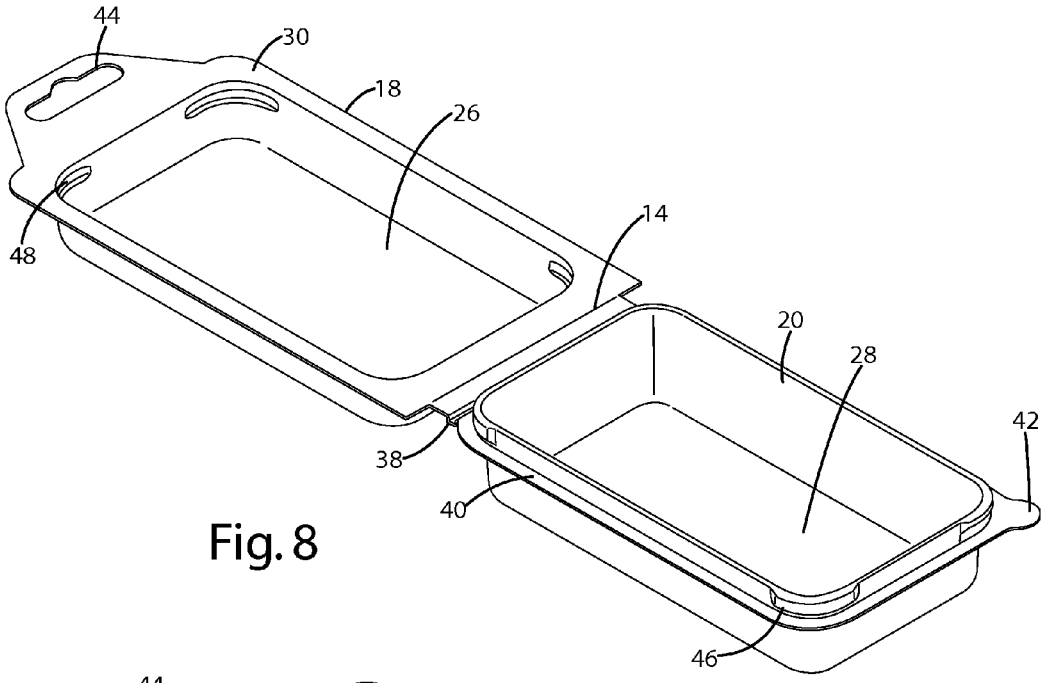
FIG. 8 is a perspective view of the clamshell in an open position.

As noted above, the first and second parts 18, 20 can be integrally formed. The integrally formed clamshell 12 can be injection molded or thermoformed or formed in any other suitable manufacturing process in one piece, such as from a single, one-sided die. The one-piece design eliminates the extra manufacturing step of aligning a separate second part 20 over the first part 18 when closing the clamshell 12. Rather, the placement of the manufacturing hinge 14 allows the first and second clamshell parts 18, 20 to be guided to an aligned, folded position when folded about the manufacturing hinge 14. When the clamshell 12 is pivoted or folded about the hinge 14 to a closed position, the first and second parts 18, 20 form the enclosed cavity 13 (FIGS. 7-9). In the illustrated embodiment, the perimeters 19, 21 of the respective pockets 26, 28 are also generally aligned when the clamshell 12 is folded (FIGS. 2 and 3).

Figure 5:
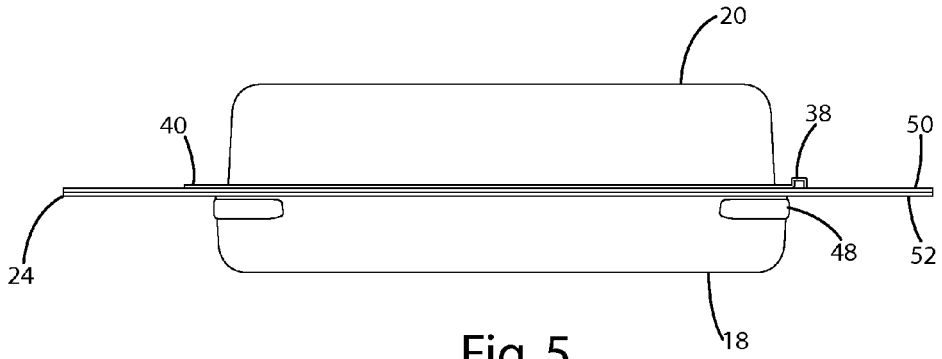
FIG. 5 is a side view of a clamshell package in a closed position.

The depth of the respective pockets 26, 28 may be the same or may vary (FIGS. 5 and 12-14). For example, as shown in FIG. 5, the pocket 28 may be deeper and may extend further outward from the panel 24 than the pocket 26 of the first part 18. In the alternative embodiment shown in FIGS. 12 and 13, the clamshell package 10' includes a pocket 28' that is significantly shallower than the pocket 26' of the first part 18'. In some embodiments, the pocket 28' may be flush with or may barely extend beyond the plane formed by the peripheral lip 40' of the second part 18'. Alternatively, in the clamshell package 10" shown in FIG. 14, the pocket 28" may be only slightly shallower than the pocket 26".

Optionally, the pocket 28 may have a standard depth for a variety of applications, with the depth of the pocket 26 varying to accommodate differently sized articles. For example, if the second part 20 forms the front or "display" side of the article, then maintaining a constant depth for the pocket 28 may result in a somewhat standard appearance of the clamshell package 10. While some features in the embodiments are described herein with respect to "front and rear" or "top and bottom" surfaces and ends, it should be understood that these designations are only included for purposes of description and could be reversed.

The first and second parts 18, 20 may be secured in a closed position using any suitable closure mechanism or retainer or fastener or the like. In the illustrated embodiment, the first and second clamshell parts 18, 20 may be snap-fitted together to hold the clamshell 12 in a closed position. For example, as shown in the illustrated embodiment, the second clamshell part 20 includes snap elements 46, which are formed as extensions or protrusions on the sidewall 27 of the pocket 28. The first clamshell part 18 includes corresponding notches 48 adapted to receive the snap elements 46 when the clamshell 12 is folded to a closed position, to retain the first and second clamshell parts together (see FIGS. 3 and 7). In the illustrated embodiment, the notches 48 and snap elements 46 are generally positioned at the corners of the first and second clamshell parts 18, 20, respectively. However, the notches 48 and snap elements 46 can be positioned in any desired location on the respective clamshell sections 18, 20.

The characteristics of the snap elements 46, such as the shape and/or length of the snap elements, may be varied to provide the stiffness desired to maintain a snap-fit between the snap elements 46 and the notches 48. For example, longer snap elements 46 may reduce the overall force required to snap-fit the second clamshell part 20 in place. Further, the leading closing edge of the snap element 46 may be non-planar to provide less resistance when snapping the snap element 46 into engagement with the notch 48. Alternatively, or additionally, the characteristics of the notch, such as size or shape, may be varied to control the force required to operate the snap-fitting interaction of the snap elements 46 and notches 48.

In the illustrated embodiment, the lip 30 on the first part 18 may be generally perpendicular to a sidewall 27 of the pocket 26 (FIG. 7). The width of the lip 30 may be generally uniform around the periphery of the first part 18, or the width may vary. For example, as shown in FIG. 6, the lip 30 may be generally uniform in width along the sides 32, 34 of the first part 16 and may increase in width across the top edge 36 of the first part 14. The wider portion of the peripheral lip 30 may define an aperture for hanging the clamshell package 10 on a display hook, which will be discussed in more detail below.

The peripheral lip 40 on the second clamshell part 20 can also be generally uniform in width about the periphery of the lip 40 or may vary in width. The peripheral lip 40 of the second part 20 may optionally be configured to engage and rest against the peripheral lip 30 of the first part 18 or against the panel 24 when the clamshell 12 is in a closed position. Optionally, the peripheral lip 40 of the second part 20 can include a tab 42 extending outward from the peripheral lip 40. The tab 42 can be pulled by a user to pull the second part 20 away from the first part 18 to open the clamshell package 10, for example, to dislodge the snap elements 46 from the notches 48. The tab 42 can be sized so that it can be readily squeezed between a user's thumb and forefinger, for example. As shown, the tab 42 is positioned at a corner of the lip 40, but the tab 42 may be positioned at any desired location on the lip 40.

Once opened, the second part 20 can pivot away from the first part 16 as far as necessary to create an opening through which the goods in the clamshell 12 can be removed. For example, the second part 20 may pivot far enough away from the first part 18 so that a user can access and remove an article such as a cellular phone case or MP3 player from the cavity 13 of the clamshell 12. As shown in FIG. 2, the spacing of the operating hinge 16 from the panel 24, thus leaving the operating hinge uncovered by the panel 24, allows the clamshell package 10 to be opened and closed repeatedly about the operating hinge 16 without peeling the panel 24 away from the clamshell 12.

Like the manufacturing hinge 14, the operating hinge 16 can be any suitable type of connection that allows the second part 20 to move with respect to the first part 18. For example, the hinge 14 can be a line of weakening in the clamshell material, such as a fold line, a line of reduced thickness or a perforation. Alternatively, the hinge 14 could be a standard hinge. Optionally, the operating hinge 16 can be positioned toward the bottom of the clamshell package 10 and opposite the hanging aperture 44, so that the contents of the clamshell 12 are supported by the clamshell 12 even when the clamshell package 10 is partially opened.

As shown, the operating hinge 16 is a square hinge 38, which can be formed as a ridge or bump or protrusion in the second part. The square hinge 38 may reinforce the second part 20 (FIG. 2). The square hinge 38 may be generally rigid, but may also allow the second part 20 to bend or flex to allow for additional pivotal movement away from the first part 18. The square hinge 38 may increase the strength and/or durability of the second part 20, which may enable the clamshell package 10 to be repeatedly opened and closed without failure of the hinge. The square hinge 38 may be facilitated by trim lines, die cuts, or other mechanisms generally know in the art.

Figure 4:
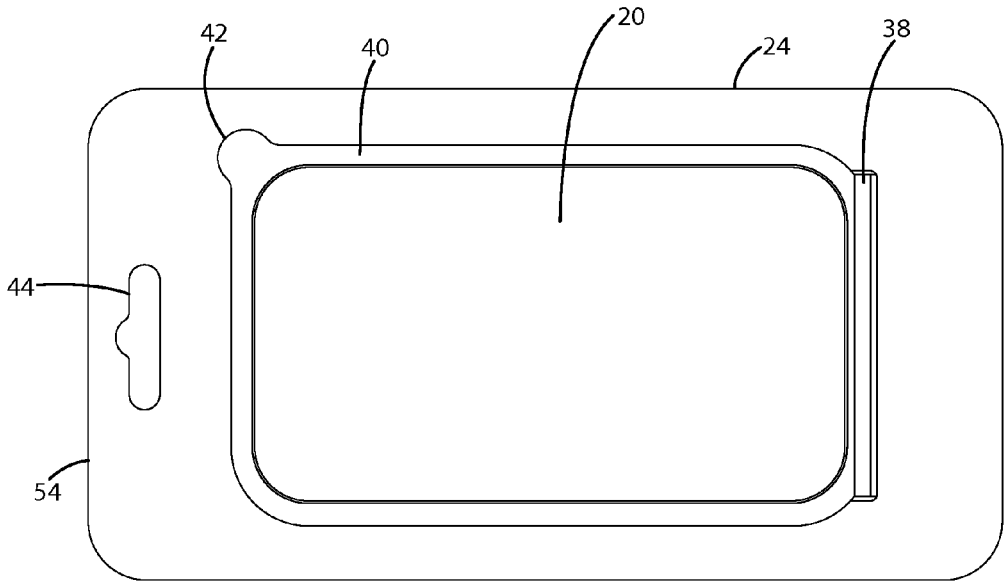
FIG. 4 is top plan view of a clamshell package in a closed position.
Figure 10:
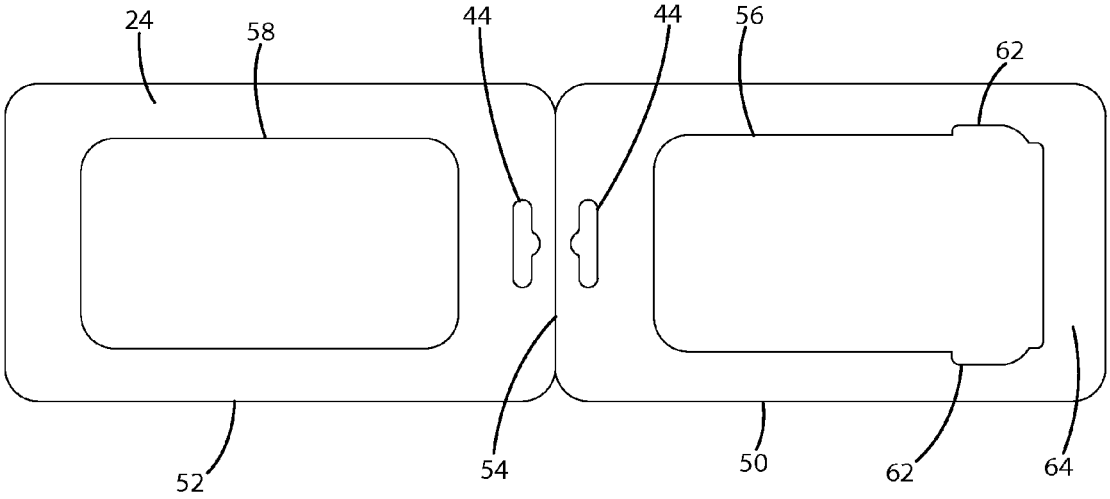
FIG. 10 is a top plan view of an unfolded panel of a clamshell package.
Figure 11:
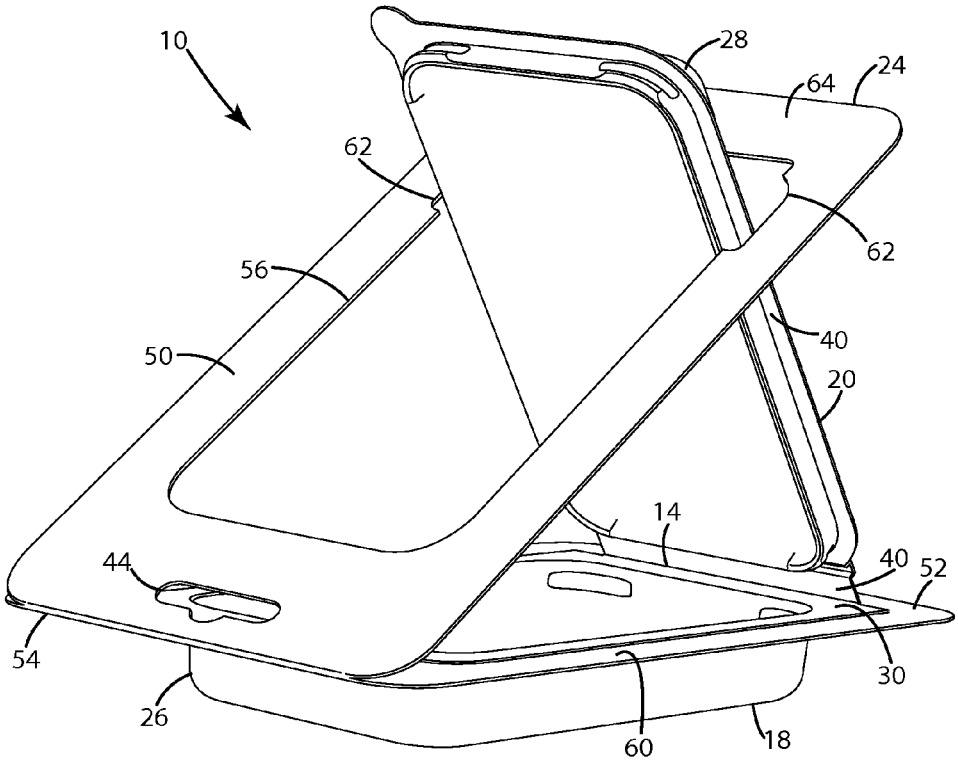
FIG. 11 is a perspective view of a method of assembling a clamshell package.
Figure 12:
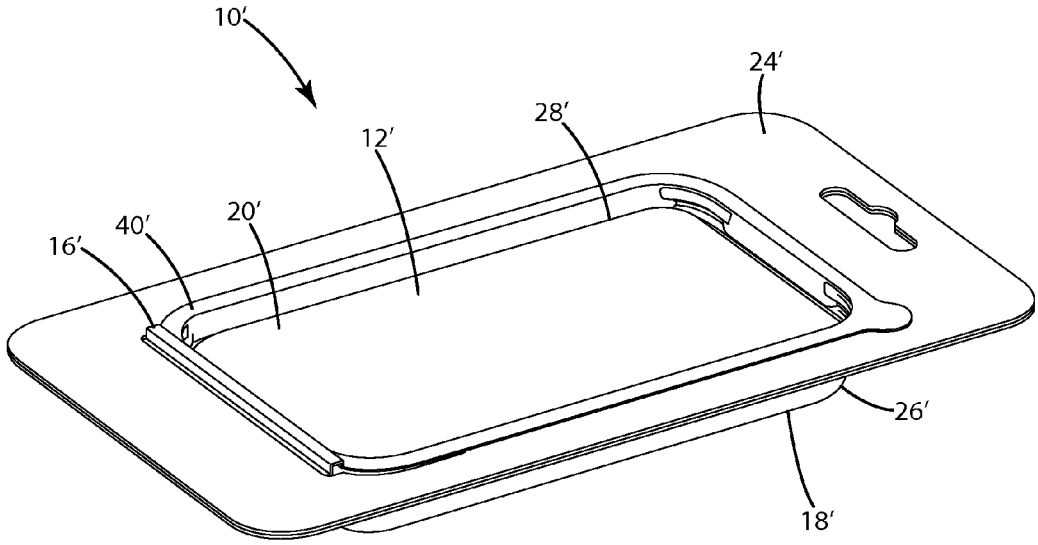
FIG. 12 is a perspective view of a clamshell package in accordance with another embodiment of the present invention.
Figure 13:
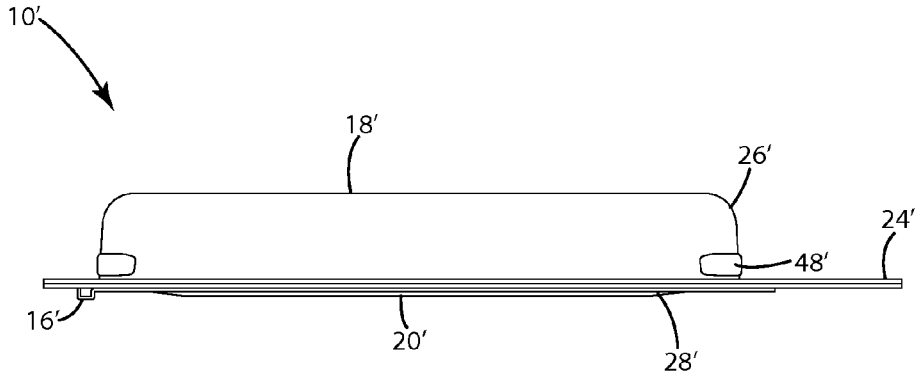
FIG. 13 is a side elevational view of the clamshell package of FIG. 12 with the panel removed.
Figure 14:
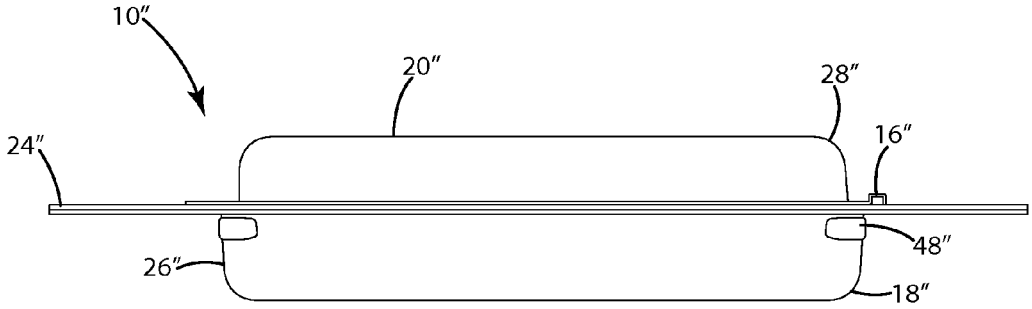
FIG. 14 is a side elevational view of a clamshell package in accordance with another embodiment of the present invention.

The panel 24 is adapted to retain the manufacturing hinge 14 in a closed position and can form a border around the clamshell 12. In the illustrated embodiment, the panel 24 includes a front sheet 50 and a rear sheet 52, which are adapted to sandwich the manufacturing hinge 14 and at least a portion of the flange 22 (FIGS. 2 and 5) to cover the manufacturing hinge and the portion of the flange 22. The front and rear sheets 50, 52 may sandwich the entire peripheral lip 30 of the first part 18, including the manufacturing hinge 14 and flange 22. Alternatively, the sheets 50, 52 may sandwich the lip 40 of the second part. The front and rear sheets 50, 52 of the panel 24 may be secured together and/or to the clamshell 12 in any suitable manner, including adhesives known in the art. For example, the panel can be secured with rubber cement or any other type of drying adhesive. However, any suitable adhesive, connector or fastener may be used to join the panel 24 to the clamshell 12. The panel 24 can be any desired size and shape depending on the dimensions of the clamshell 12 and on the article to be packaged. The sheet Optionally, the front and rear sheets 50, 52 may be integrally formed or otherwise joined. For example, as shown in FIGS. 10-11, the sheets 50, 52 are integrally formed and are adapted to be folded along a fold line 54, which, when folded about the clamshell 12, forms the upper peripheral edge 54 of the panel 24 (FIG. 4). In the illustrated embodiment, the front sheet 50 includes an opening 56, and the rear sheet 52 includes an opening 58. The openings 56 and 58 can be selectively sized and shaped to accommodate the clamshell 12 and can be selectively positioned so that the openings are generally aligned when the panel 24 is folded. The opening 56 in the front sheet 50 may include selectively placed cut-outs 62, which extend beyond the general shape of the opening 56 and which will be explained in more detail below. In another embodiment, the sheets 50, 52 may be separate pieces, or they may alternatively be formed from a single piece and folded about a score line, perforation, or the like.

To assemble the clamshell 12 and the integrally formed panel 24, the first part 18 of the clamshell 12 can be inserted, bottom first, into the opening 58 formed by the rear sheet 52 (FIG. 11). The first part 18 can be pressed downward into the opening until the lip 30 engages a top surface 60 of the rear sheet 52. In the illustrated embodiment, this step is performed while the clamshell 12 is in an open, unfolded position. The second part 20 is then folded about the manufacturing hinge 14, and the front sheet 50 is folded along the fold line 54, such that the front sheet 50 and second part 20 are pivoting toward each another. To allow the second part 18 to pass through the opening 56, and specifically to accommodate the peripheral lip 40 of the second part 18, cut-outs 62 may be formed in the front sheet 50 about the peripheral edge of the opening 56. The size and shape of the cut-outs 62 can be selectively chosen to accommodate the width of the second part 20 and the lip 40. The second part 20 can then pass completely through the opening 56, through the cut-outs 62, which positions the front sheet 50 on top of the rear sheet 52, with the lip 30 of the first part 18 being sandwiched between the front and rear sheets 50, 52 (FIG. 2). The lower portion 64 of the front sheet 50 clamps or otherwise secures the lip 40 against the lip 30 to form the flange 22 and to assist in retaining the flange 22 in an overlapped position. The opening 56 in the front sheet 50 and the size of the lower portion 64 may be selectively arranged so that the front sheet 50 is sufficiently spaced from the operating hinge 16 of the second part 20. The lower portion 64 therefore covers at least a portion of the flange 22, but is spaced from the operating hinge 16 to expose the operating hinge and allow the operating hinge 16 to function. The second part 20 can then pivot about the operating hinge 16 to open or close the package 10. In one embodiment, the lower portion 64 of the panel 24 is spaced about 0.0625 inches from the operating hinge 16, but the spacing may vary from application to application.

The panel 24 can be constructed out of paperboard material. However, other materials commonly known in the art, such as plastic, may also be used. Optionally, the panel 24 may define a hanging aperture 44, which aligns with the aperture 44 in the clamshell 12, for hanging the clamshell package 10 from a display hook at a point of sale as shown in FIG. 3. The size, shape and location of this hanging aperture 44 will vary depending on the article offered for sale. In one embodiment, only one of the panel 24 and the clamshell 12 may include the aperture 44, enabling a reduction in size of the item that does not include the aperture 44.

In another aspect, a method is provided for forming a clamshell package, such as the clamshell package 10 described above. The method includes the steps of: (a) forming a plastic clamshell 12 including a manufacturing hinge 14 adapted to divide the clamshell into first and second parts 18, 20, the second part 20 including a operating hinge 16; (b) folding the clamshell 12 about the manufacturing hinge 14 to form a cavity 13 between the first and second parts, with the first and second parts forming a flange 22 adjacent the manufacturing hinge 14; (c) attaching a panel 24 to the manufacturing hinge 14 and flange 22 of the clamshell 12; and (d) pivoting the second part 20 about the operating hinge 16 to open the clamshell package 12.

In one embodiment, the step of forming the plastic clamshell 12 can include placing a piece of sheet stock in a mold and thermoforming the clamshell. The molding or thermoforming step can include forming pockets in the respective first and second parts 18, 20. This step can also include (a) forming the first part with at least one notch 48 and forming the second part with at least one snap element 50 adapted to snap into the notch, and (b) forming a reinforcing square hinge 38 in the second part and spacing the square hinge 38 from the manufacturing hinge 14 and the panel 24. As discussed above, the spacing of the operating hinge 16 from the panel 24 may reduce the likelihood that the panel 24 will peel away or otherwise separate from the clamshell 12.

Optionally, the step of attaching a panel 24 can include securing front and rear sheets 50, 52 about the peripheral lip 30 of the first part. The securing step can include using an adhesive, such as rubber cement, to secure the front and rear sheets to each other and to the clamshell.

The above description is that of the current embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are as follows:

1. A package for packaging an article comprising:

a first part with a peripheral lip;

a second part having an operating hinge, said operating hinge dividing said second part into a flange portion and a cavity portion; and a first fixed panel and a second fixed panel, said first and second fixed panels sandwiching said peripheral lip and said flange portion of the second part, said cavity portion being unsandwiched by said first fixed panel and said second fixed panel, whereby said cavity portion is pivotable with respect to said first part about said operating hinge between open and closed positions while said flange portion and said peripheral lip remain sandwiched between said first and second fixed panels, wherein said second part has at least one fastener element for releasably securing said cavity portion in said closed position.

2. The package of claim 1 wherein said flange portion is secured to said first part peripheral lip.

3. The package of claim 2 wherein said flange portion is secured to said first part peripheral lip by a manufacturing hinge.

4. The package of claim 3 wherein said first and second parts are thermoformed from a single piece of stock material.

5. The package of claim 1 wherein said first and second fixed panels are integrally formed and are adapted to be folded about a fold line.

6. The package of claim 5 wherein each of said first and second fixed panels include a respective opening adapted to receive one of said first and second parts.

7. The package of claim 1 wherein said operating hinge is a square hinge.

8. The package of claim 1 wherein said operating hinge is at least one of a line of weakening, a perforation, a bend and a line of reduced thickness.

9. The package of claim 1 wherein said at least one fastener element includes a snap element in one of said first and second parts and a notch in the other of said first and second parts, wherein said snap element is adapted to be snap-fitted into said notch for retaining said first and second parts in a closed position.

10. The package of claim 1 wherein said cavity portion engages one of said first panel and second panel when the package is in a closed position.

11. The package of claim 1 wherein said first and second panels are secured to the peripheral lip and said flange portion.

12. A package for packaging an article comprising:

a first part with a peripheral lip;

a second part having an operating hinge dividing said second part into a movable portion and a flange;

a first fixed panel covering said peripheral lip from one side;

a second fixed panel covering said flange and said peripheral lip from an opposite side such that said peripheral lip and said flange are sandwiched between said first fixed panel and said second fixed panel, said operating hinge and said movable portion uncovered by said second fixed panel, said movable portion being pivotable about said operating hinge with respect to said flange while said flange remains covered by said fixed panel, said movable portion being movable between open and closed positions, wherein said first and second parts are releasably secured when said first and second parts are in said closed position.

13. The package of claim 12 wherein said flange is located along a peripheral edge of the package.

14. The package of claim 13 wherein said first and second parts are connected.

15. The package of claim 14 wherein said first and second parts are connected with a manufacturing hinge.

16. The package of claim 13 wherein a front panel and a rear panel sandwich the flange.

17. A package for packaging an article comprising:

first and second panels secured to one another in face to face relationship, said first panel defining a first opening, said second panel defining a second opening, said first opening and said second opening being in at least partial alignment; and a clamshell having first and second parts joined by a hinge, said first and second parts being pivotally movable with respect to one another between open and closed position, said first and second parts cooperatively defining a closed cavity when in said closed position, said first part having a first peripheral lip disposed between said first and second panels and a pocket extending through said first opening, said second part having a shoulder and a second peripheral lip, said shoulder configured such that when in said closed position said shoulder extends through said first opening and said second opening into said pocket, said second peripheral lip remaining substantially external to said first and second panels in said open position and said closed position, whereby said second part is capable of movement between said open and closed positions without interference from said front panel and said second panel.

18. The package of claim 17 wherein said peripheral lip of said first part includes at least a section uncovered by said second panel.

19. The package of claim 18 wherein said uncovered section of said first part peripheral lip substantially includes a width of said peripheral lip.

20. The package of claim 18 wherein at least a portion of said second panel is disposed on said second peripheral lip.

21. The package of claim 17 wherein said hinge is external to one of said first and second panels.

22. A package for packaging an article comprising:

a first part with a peripheral lip;

a second part with a shoulder and a peripheral lip, said first part peripheral lip joined to said second part peripheral lip by a hinge; and a panel having first and second portions joined together about said first part peripheral lip, whereby said first part is immovably secured between said first and second portions; said second part being capable of pivotal movement between open and closed positions with respect to said first part, said first portion and said second potion, said second part peripheral lip being substantially external to said first and second portions throughout an entire range of motion of said second part, said shoulder extending into said first part when in said closed position.

23. The package of claim 22 wherein said first part peripheral lip includes at least a section that is uncovered by at least one of said first or said second panels.

24. A package for packaging an article comprising:

a clamshell having a first part, a second part and a hinge allowing said first part to pivot with respect to said second part between open and closed positions, said first part having a peripheral lip; and a first panel and a second panel, said first and second panels sandwiching said peripheral lip, said hinge being covered by said first panel and uncovered by said second panel, whereby said second part may be freely pivoted about said hinge between said open and closed positions without interference from said second panel.

* * * * *

UNITED STATES PATENT AND TRADEMARK OFFICE

CERTIFICATE OF CORRECTION

PATENT NO. : 8,496,111 B2
APPLICATION NO. : 13/053514
DATED : July 30, 2013
INVENTOR(S) : Victor D. Hansen et al.

It is certified that error appears in the above-identified patent and that said Letters Patent is hereby corrected as shown below:

Delete the title page and substitute therefore with the attached title page showing the corrected number of claims in patent.

In the Claims:
Column 8, Line 30:
Replace claims 1-24 with claims 1-20 below:

1. A package for packaging an article comprising: a first part with a peripheral lip; a second part having an operating hinge, the operating hinge dividing the second part into a flange portion and a cavity portion; and a front panel and a rear panel, the front and rear panels sandwiching the peripheral lip and only the flange portion of the second part, the operating hinge spaced from and uncovered by the panels, the cavity portion being unsandwiched by the front and rear panels, the cavity portion pivotable with respect to the first part about the operating hinge between open and closed positions while the flange portion and the peripheral lip remain sandwiched between the front and rear panels, wherein the first and second parts have at least one fastener element, the fastener element releasably securing the first and second parts in the closed position.

2. The package of claim 1 wherein the flange portion is secured to the first part peripheral lip.

3. The package of claim 2 wherein the flange portion is secured to the first part peripheral lip by a manufacturing hinge.

4. The package of claim 3 wherein the first and second parts are thermoformed from a single piece of stock material.

5. The package of claim 1 wherein the front and rear panels are integrally formed and are adapted to be folded about a fold line.

Signed and Sealed this
Third Day of December, 2013

Margaret A. Focarino

Margaret A. Focarino
*Commissioner for Patents of the United States Patent and Trademark Office*

6. The package of claim 5 wherein the front and rear panels include a respective opening adapted to receive one of the first and second parts.

7. The package of claim 1 wherein the operating hinge is a square hinge.

8. The package of claim 1 wherein the operating hinge is at least one of a line of weakening, a perforation, a bend and a line of reduced thickness.

9. The package of claim 1 wherein the at least one fastener element includes a snap element in one of the first and second parts and a notch in the other of the first and second parts, wherein the snap element is adapted to be snap-fitted into the notch for retaining the first and second parts in a closed position.

10. The package of claim 1 wherein the cavity portion engages one of the front panel and rear panel when the package is in a closed position.

11. The package of claim 1 wherein the front and rear panels are secured to the peripheral lip and the flange portion.

12. A package for packaging an article comprising: a first part and a second part; an operating hinge on the second part, the operating hinge dividing the second part into a movable portion and a flange; and a panel covering the flange, the operating hinge is and the movable portion uncovered by the panel, the movable portion being pivotable about the operating hinge with respect to the flange while the flange remains covered by the panel, wherein the first and second parts are releasably secured when the first and second parts are in a closed position.

13. The package of claim 12 wherein the flange is located along a peripheral edge of the package.

14. The package of claim 13 wherein the first and second parts are connected.

15. The package of claim 14 wherein the first and second parts are connected with a manufacturing hinge.

16. The package of claim 13 wherein a front panel and a rear panel sandwich the flange.

17. A method for forming a package comprising the steps of: forming a first part and a second part, the second part including an operating hinge, the operating hinge dividing the second part into a flange portion and a movable portion; positioning the first part adjacent the second part to form a cavity between the first part and the movable portion; attaching a panel to the flange portion, the panel covering at least a portion of the flange portion while leaving the operating hinge and the movable portion uncovered by the panel; and pivoting the second part away from the first part about the operating hinge to open the package while the panel covers at least a portion of the flange portion.

18. The method of claim 17 wherein the forming a first part and a second part step includes placing a piece of sheet stock in a mold and thermoforming the first and second parts.

19. The method of claim 17 wherein the attaching a panel step includes sandwiching at least a portion of the flange portion between a front panel and a rear panel.

20. The method of claim 19 further comprising: integrally forming the front and rear panels, including forming a fold line between the front and rear panels and forming an opening in each of the front and rear panels; inserting the first part into the opening in the rear panel; and folding the front panel about the fold line until the front panel engages at least one of the first part and the rear panel.

(12) United States Patent
Hansen et al.

(10) Patent No.: US 8,496,111 B2
(45) **Date of Patent: *Jul. 30, 2013**

(54) DOUBLE HINGE DISPLAY PACKAGE AND METHOD OF USE

(75) Inventors: Victor D. Hansen, Rockford, MI (US); George E. Raimer, Saranac, MI (US); Kristie L. Vos, Marne, MI (US); Brian J. Pankratz, Rockford, MI (US); Michael J. Cramblet, Muskegon, MI (US); Elliott R. Eckert, East Grand Rapids, MI (US)

(73) Assignee: Display Pack, Inc., Grands Rapids, MI (US)

( * ) Notice: Subject to any disclaimer, the term of this patent is extended or adjusted under 35 U.S.C. 154(b) by 268 days.

This patent is subject to a terminal disclaimer.

(21) Appl. No.: 13/053,514

(22) Filed: Mar. 22, 2011

(65) Prior Publication Data

US 2011/0168731 A1 Jul. 14, 2011

Related U.S. Application Data

(63) Continuation of application No. 12/640,053, filed on Dec. 17, 2009, now Pat. No. 7,931,148, which is a continuation-in-part of application No. 29/338,389, filed on Jun. 10, 2009, now Pat. No. Des. 624,402.

(51) Int. Cl.
*B65D 73/00* (2006.01)

(52) U.S. Cl.
USPC ..... 206/470; 206/461; 206/463; 220/4.23; 220/254.1; 220/254.3

(58) Field of Classification Search
USPC ..... 206/349, 470, 471, 365, 467, 461, 206/463; 220/824, 4.22, 4.23, 254.1, 254.3
See application file for complete search history.

(56) References Cited

U.S. PATENT DOCUMENTS

| | | | | |
|---|---|---|---|---|
| 3,111,220 | A | 11/1963 | Donald | |
| 4,083,451 | A * | 4/1978 | Hair | 206/461 |
| 4,266,666 | A | 5/1981 | Kuchenbecker | |
| 4,319,684 | A * | 3/1982 | Backman et al. | 206/464 |
| D263,684 | S | 4/1982 | Davis | |
| 4,456,124 | A * | 6/1984 | Kay et al. | 206/463 |
| 4,666,037 | A | 5/1987 | Weissman | |
| 4,739,883 | A * | 4/1988 | Mohs et al. | 206/470 |
| D376,314 | S | 12/1996 | Krupa | |
| 5,775,516 | A | 7/1998 | McCumber et al. | |
| D407,015 | S | 3/1999 | Jones | |
| D411,448 | S | 6/1999 | Baker | |
| D420,905 | S | 2/2000 | Adkins | |

(Continued)

OTHER PUBLICATIONS

Design Drawings dated Feb. 2, 2009.

*Primary Examiner* — Andrew Perreault
(74) *Attorney, Agent, or Firm* — Warner Norcross & Judd LLP

(57) ABSTRACT

A clamshell package for supporting an article is provided including a covered manufacturing hinge adapted to divide the clamshell into first and second parts adapted to form a cavity. The first and second parts partially overlap to form a flange adjacent the manufacturing hinge. The second part includes an uncovered operating hinge, about which the second part is adapted to pivot away from the first part to an open position. The clamshell package includes a panel adapted to engage the manufacturing hinge and flange to retain the manufacturing hinge in a folded position, with the panel being spaced from the operating hinge.

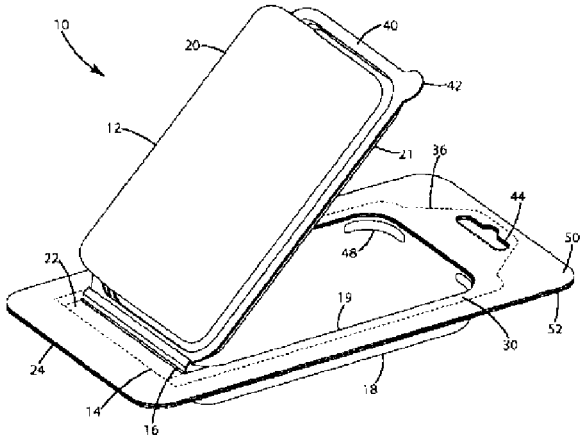

20 Claims, 6 Drawing Sheets